US010598020B2

(12) United States Patent
Amador

(10) Patent No.: US 10,598,020 B2
(45) Date of Patent: Mar. 24, 2020

(54) SPANNER NUT CENTERING FEATURE

(71) Applicant: United Technologies Corporation, Farmington, CT (US)

(72) Inventor: Armando Amador, Wethersfield, CT (US)

(73) Assignee: United Technologies Corporation, Farmington, CT (US)

( * ) Notice: Subject to any disclaimer, the term of this patent is extended or adjusted under 35 U.S.C. 154(b) by 197 days.

(21) Appl. No.: 15/863,452

(22) Filed: Jan. 5, 2018

(65) Prior Publication Data

US 2019/0211877 A1 Jul. 11, 2019

(51) Int. Cl.
*F01D 5/06* (2006.01)
*F01D 25/16* (2006.01)

(52) U.S. Cl.
CPC ..... *F01D 5/066* (2013.01); *F01D 25/162* (2013.01); *F05D 2220/32* (2013.01); *F05D 2230/60* (2013.01); *F05D 2240/50* (2013.01); *F05D 2260/30* (2013.01); *F05D 2260/98* (2013.01)

(58) Field of Classification Search
CPC ..... F01D 25/162; F01D 25/18; F01D 5/066; F16C 19/16; F16C 35/06
See application file for complete search history.

(56) References Cited

U.S. PATENT DOCUMENTS 3,722,058 A * 3/1973 Corsmeier ..... B23P 19/00 29/270
6,322,081 B1 * 11/2001 Ullah ..... F16C 33/76 277/504
8,579,538 B2 11/2013 Juh et al.
9,500,100 B2 11/2016 Carter et al.
9,695,870 B2 7/2017 Amador et al.
2003/0044097 A1 * 3/2003 Trapp ..... F01D 25/16 384/540
2005/0013696 A1 * 1/2005 Le Jeune ..... F01D 5/025 416/244 A (Continued)

FOREIGN PATENT DOCUMENTS

WO WO2014/004491 A1 1/2014
WO WO2015/108628 A1 7/2015

OTHER PUBLICATIONS

Extended European Search Report for EP Application No. 18204424.8, dated May 23, 2019, 7 pages.

*Primary Examiner* — Woody A Lee, Jr.
(74) *Attorney, Agent, or Firm* — Kinney & Lange, P.A.

(57) ABSTRACT

A spanner nut for a bearing compartment of an engine with a bearing stack on a first shaft that rotates about an engine centerline includes a body, a piloting hook connected to the body, a first threaded portion, and a channel formed by the piloting hook. The piloting hook includes first and second extensions. The first extension is connected to and extends radially inward from the body. The second extension is connected to and extends in an axial direction from the first extension. The second extension includes a radially outward facing surface. The first threaded portion is configured to engage with a second threaded portion on the end of the first shaft. The channel is configured to receive the end of the first shaft. The piloting hook is configured to draw the second extension radially outward as the spanner nut is compressed.

19 Claims, 10 Drawing Sheets

(56) References Cited

U.S. PATENT DOCUMENTS

| | | | | |
|---|---|---|---|---|
| 2011/0052372 | A1* | 3/2011 | Lecuyer | F01D 5/025<br>415/115 |
| 2013/0089432 | A1* | 4/2013 | Mundell | F01D 5/066<br>416/244 R |
| 2017/0114650 | A1 | 4/2017 | Snyder | |
| 2017/0114651 | A1 | 4/2017 | Snyder et al. | |

* cited by examiner

SPANNER NUT CENTERING FEATURE

STATEMENT OF GOVERNMENT INTEREST

This invention was made with government support under N00019-02-C-3003 awarded by United States Navy. The government has certain rights in the invention.

BACKGROUND

The present disclosure relates to a gas turbine engine. More particularly, the present disclosure relates to a spanner nut for gas turbine engines.

Existing spanner nuts in bearing compartments of gas turbine engines tend to separate a seal member of a bearing stack from the spacer nut. This separation typically occurs because the spanner nut is unable to provide an amount of radial excursion control required by the sealing member. This separation also causes runout, or axial misalignment, between the spanner nut and the rotating engine shaft.

SUMMARY

A spanner nut for a bearing compartment of an engine includes a body, a piloting hook connected to the body, a first threaded portion, and a channel formed by the piloting hook. The piloting hook includes first and second extensions. The first extension is connected to and extends radially inward from the body. The second extension is connected to and extends in an axial direction from the first extension. The second extension includes a radially outward facing surface. The first threaded portion is configured to engage with a second threaded portion on the end of the first shaft. The channel is configured to receive the end of the first shaft. The piloting hook is configured to draw the second extension radially outward as the spanner nut is compressed.

A method of installing a spanner nut onto a shaft in a bearing compartment of an engine and includes threadably engaging the spanner nut with an end of the shaft. A bearing stack is disposed on the shaft. A piloting hook of the spanner nut is disposed radially inward from a portion of the shaft such that there is a distance greater than zero between a radially outward facing surface of the piloting hook and a radially inward facing surface of the shaft. The spanner nut is rotated relative to the shaft such that threading on the spanner nut interacts with threading on the shaft to translate the spanner nut in an axial direction towards the bearing stack. The spanner nut is brought into contact with the bearing stack. The spanner nut is tightened against the bearing stack such that the spanner nut compresses against the bearing stack and the spanner nut expands radially outward drawing the piloting hook radially outward and into contact with the inner surface of the shaft.

An assembly for a bearing compartment of an engine includes a first shaft disposed in the engine and co-axial with the engine centerline, a bearing stack disposed on a portion of the first shaft, and a spanner nut disposed on the end of the first shaft and in contact with the bearing stack. The first shaft includes an end with a radially inward facing surface and a first threaded portion disposed on the end of the shaft. The spanner nut includes a body, a piloting hook connected to the body, a second threaded portion configured to engage with the first threaded portion on the end of the first shaft, and a channel formed by the piloting hook. The piloting hook includes first and second extensions. The first extension is connected to and extends radially inward from the body. The second extension is connected to and extends in an axial direction from the first extension. The second extension includes a radially outward facing surface. The channel is configured to receive the end of the first shaft. The piloting hook is configured to cause the radially outward facing surface of the second extension to contact the radially inward facing surface of the end of the shaft.

DETAILED DESCRIPTION

Figure 1:
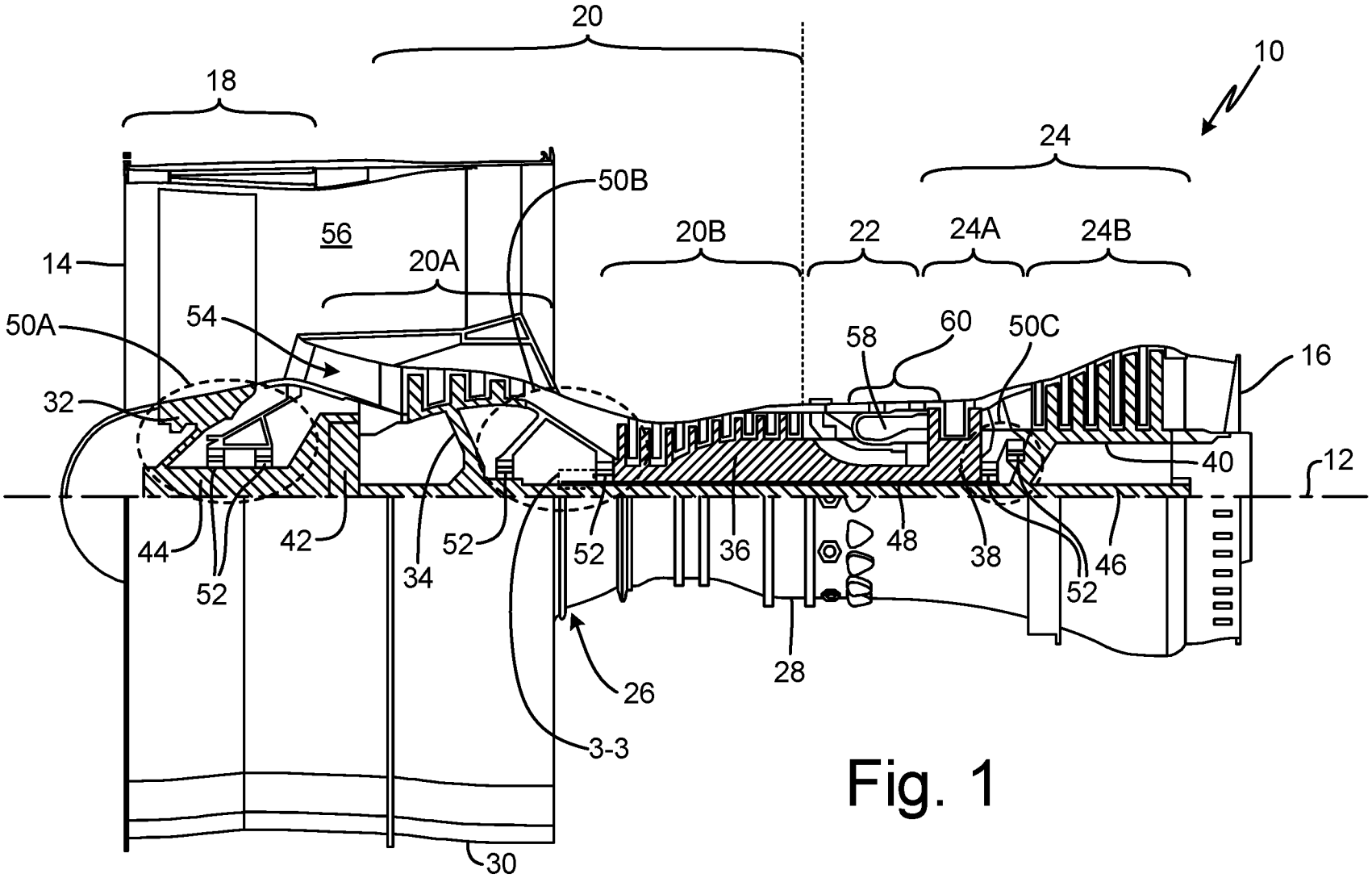
FIG. 1 is a side partial cross-section view of an engine.

FIG. 1 shows a side elevation cutaway view of gas turbine engine 10 and includes axial centerline 12, upstream airflow inlet 14, downstream airflow exhaust 16, fan section 18, compressor section 20 (with low pressure compressor ("LPC") section 20A and high pressure compressor ("HPC") section 20B), combustor section 22, turbine section 24 (with high pressure turbine ("HPT") section 24A and low pressure turbine ("LPT") section 24B), engine housing 26 (with inner case 28 (e.g., a core case) and outer case 30 (e.g., a fan case)), fan rotor 32, LPC rotor 34, HPC rotor 36, HPT rotor 38, LPT rotor 40, gear train 42, fan shaft 44, low speed shaft 46, high speed shaft 48, bearing compartments 50A, 50B, and 50C, plurality of bearings 52, core gas path 54, bypass gas path 56, combustion chamber 58, combustor 60, accessory gearbox 62, gearbox attachments 64, transmission system 66, tower shaft 68, and geared system 70.

Gas turbine engine 10 extends along axial centerline 12 between upstream airflow inlet 14 and downstream airflow exhaust 16. Gas turbine engine 10 includes fan section 18, compressor section 20, combustor section 22, and turbine section 24. Compressor section 20 includes LPC section 20A and HPC section 20B. Turbine section 24 includes HPT section 24A and LPT section 24B.

Fan section 18, compressor section 20, combustor section 22, and turbine section 24 are arranged sequentially along centerline 12 within engine housing 26. Engine housing 26 includes inner case 28 (e.g., a core case) and outer case 30 (e.g., a fan case). Inner case 28 may house one or more of fan section 18, compressor 20, combustor section 22, and turbine section 24 (e.g., an engine core). Outer case 30 may house at least fan section 18. Each of gas turbine engine sections 18, 20A, 20B, 24A and 24B includes respective rotors 32-40. Each of these rotors 32-40 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

Fan rotor 32 is connected to gear train 42, for example, through fan shaft 44. Gear train 42 and LPC rotor 34 are connected to and driven by LPT rotor 40 through low speed shaft 46. The combination of at least LPC rotor 34, LPT rotor 40, and low speed shaft 46 may be referred to as "a low speed spool." HPC rotor 36 is connected to and driven by HPT rotor 38 through high speed shaft 48. The combination of at least HPC rotor 36, HPT rotor 38, and high speed shaft 48 may be referred to as "a high speed spool." Shafts 44-48 are rotatably supported by a plurality of bearings 52, which can be rolling element bearings, thrust bearings, or other types of bearings. Each of these bearings 52 is connected to engine housing 26 by at least one stationary structure such as, for example, an annular support strut.

During operation, air enters gas turbine engine 10 through airflow inlet 14. Air is directed through fan section 18 and is then split into either core gas path 54 or bypass gas path 56. Core gas path 54 flows sequentially through fan section 18, compressor section 20, combustor section 22, and turbine section 24. The air within core gas path 54 may be referred to as "core air." Bypass gas path 56 flows through a duct between inner case 28 and outer case 30. The air within bypass gas path 56 may be referred to as "bypass air."

The core air is compressed by LPC rotor 34 and HPC rotor 36 and directed into combustion chamber 58 of combustor 60 in combustor section 22. Fuel is injected into combustion chamber 58 and mixed with the core air that has been compressed by compressor section 20 to provide a fuel-air mixture. This fuel-air mixture is ignited and combustion products thereof expand and flow through and sequentially cause HPT rotor 38 and LPT rotor 40 to rotate. The rotations of HPT rotor 38 and LPT rotor 40 drive rotation of LPC rotor 34 and HPC rotor 36, respectively and compression of the air received from core gas path 54. The rotation of LPT rotor 40 also drives rotation of fan rotor 32, which propels bypass air through and out of bypass gas path 56. The propulsion of the bypass air may account for a majority of thrust generated by gas turbine engine 10, which can be more than 75% of engine thrust. Gas turbine engine 10 of the present disclosure, however, is not limited to the foregoing exemplary thrust ratio.

Gas turbine engine 10 of FIG. 1 also includes accessory gearbox 62, one or more gearbox attachments 64 and transmission system 66 in a mid-bearing compartment between LPC section 20A and HPC section 20B. Accessory gearbox 62 is mounted to inner case 28. However, in alternative embodiments, accessory gearbox 62 may be mounted elsewhere with gas turbine engine 10, such as to outer case 30. Accessory gearbox 62 is configured to transfer rotational energy (e.g., torque) between transmission system 66 and the one or more gearbox attachments 64. Examples of a gearbox attachment may include an air turbine starter, a de-oiler, a hydraulic pump, an oil pump, an integrated drive generator, a permanent magnet alternator and a fuel pump module. The present disclosure is not limited to including the foregoing exemplary types or configurations of accessory gearbox 62 or gearbox attachments 64.

Transmission system 66 is configured to mechanically couple and thereby transfer rotational energy (e.g., torque) between a rotating assembly (or component) of gas turbine engine 10 and accessory gearbox 62. In particular, transmission system 66 of FIG. 1 mechanically couples one of the low speed spool or high speed spool of gas turbine engine 10 to the accessory gearbox 62. Transmission system 66 includes high speed shaft 48, tower shaft 68, and geared system 70.

Figure 2A:
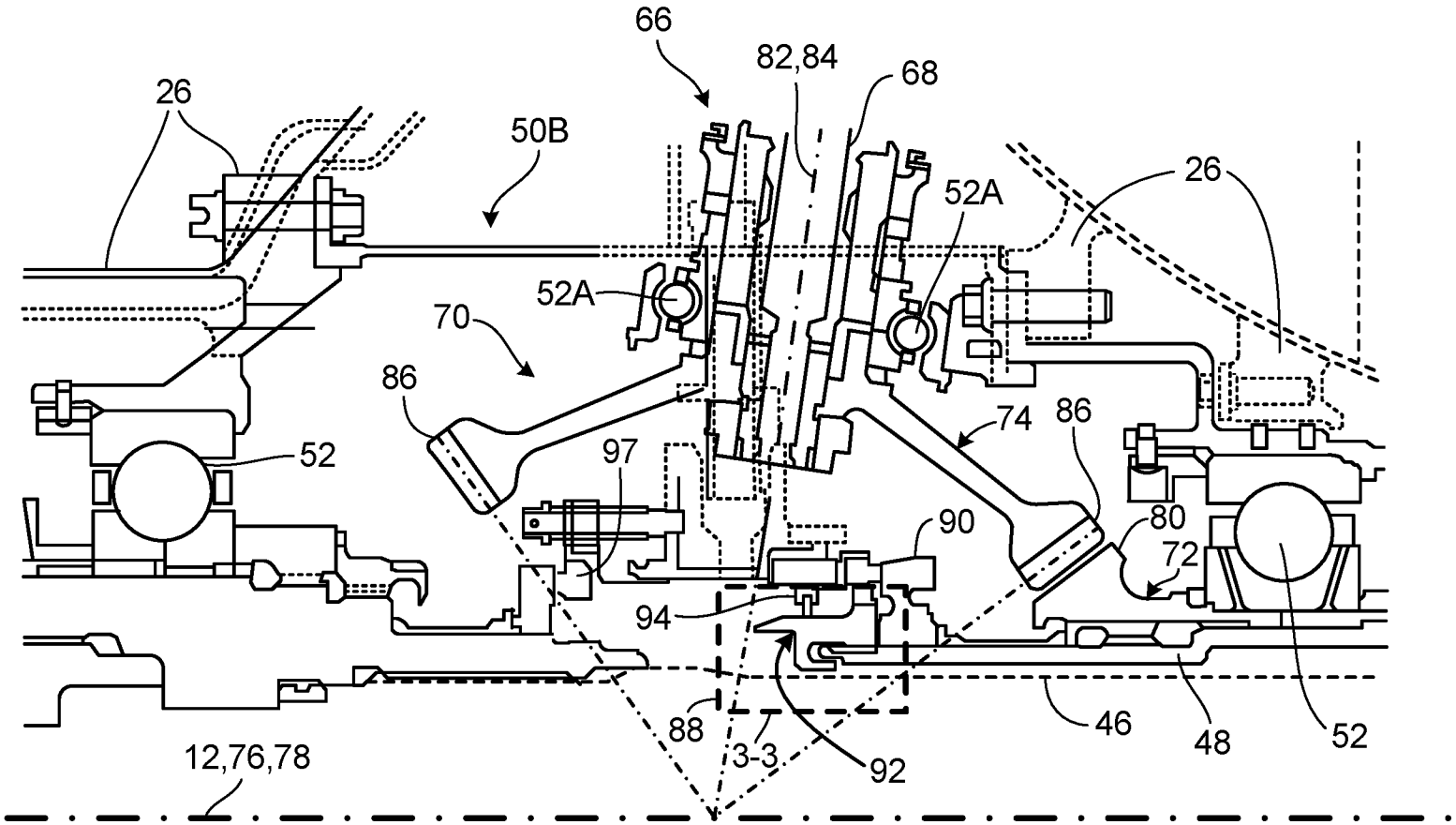
FIG. 2A is a cross-section view of a bearing compartment of the turbine engine.

FIG. 2A shows a cross-section view of bearing compartment 50B of turbine engine 10 and includes bearings 52 and 52A, low speed shaft 46 (shown in phantom for clarity), high speed shaft 48, transmission system 66, geared system 70 (with first gear 72, second gear 74, rotational axis 76 of first gear 72, rotational axis 78 of low speed shaft 46, first set of gear teeth 80, rotational axis 82 of second gear 74, rotational axis 84 of tower shaft 68, and second set of gear teeth 86), assembly 88 (with bearing stack 90, spanner nut 92, and seal element 94).

Transmission system 66 is within bearing compartment 50B (e.g., a mid-bearing compartment of gas turbine engine 10) and includes geared system 70, which contains first gear 72 and second gear 74. In other non-limiting embodiments, bearing compartment 50B can include other bearing compartments besides a mid-bearing compartment, such as a forward or aft bearing compartment. FIG. 2A shows high speed shaft 48 adjacent to low speed shaft 46 on a radially inner side and to bearing 52 and first gear 72 on a radially outer side. In turn, bearing 52 is connected to engine housing 26. First gear 72 is mounted to high speed shaft 48, for example, by a splined interface. First gear 72 rotates around rotational axis 76, which is coaxial with rotational axis 78 of low speed shaft 46 and centerline 12. FIG. 2A also shows tower shaft 68 connected to second gear 74 and held in place by bearings 52A connected to engine housing 26. Second gear 74 of FIG. 2A is configured as a bevel gear and is mounted to tower shaft 68, for example, by a splined interface. Second gear 74 rotates around rotational axis 82, which is coaxial with rotational axis 84 of tower shaft 68. Rotational axis 84 is arranged coincident with the rotational axis 76 of first gear 72.

Assembly 88 includes bearing stack 90, spanner nut 92, and seal element 94. Bearing stack 90 is stack of one or more machine elements. In one non-limiting embodiment, bearing stack 90 can include one or more of seal seats, runners, knife edges, gears, a shaft or hub shoulder, spacers, springs, or bearings. Spanner nut 92 is a threaded annular coupler with elements for mechanical engagement and is configured to rotate within gas turbine engine 10. Seal element 94 is an annular seal element. In some non-limiting embodiments, seal element 94 can include one or more of brush seal(s), ring seal, control gap seal, finger seal, segmented carbon seal(s), arch bound seal(s), knife edge seal (labyrinth), fluorocarbon based sealing element, abradable seal component, or piston ring(s).

Bearing stack 90 and spanner nut 92 are disposed on and around high speed shaft 48. In other non-limiting embodiments, bearing stack 90 and/or spanner nut 92 can be attached to a main shaft of gas turbine engine 10 or other rotating shafts such as fan shaft 44, low speed shaft, 46, or tower shaft 68. Spanner nut 92 is attached to and threadably engaged with high speed shaft 48. Spanner nut 92 is screwed onto high speed shaft 48 such that spanner nut 92 is drawn axially closer to bearing stack 90 and presses against a portion of bearing stack 90. A portion of seal element 94 is engaged with spanner nut 92 to form a seal. In one non-limiting embodiment, the interface between seal element 94 and spanner nut 92 is configured to create an air-to-air seal. The seal interface between seal element 94 and spanner nut 92 prevents oil and/or air from leaking out of or into bearing compartment 50B. As will be discussed with FIG. 2B, the single piece configuration of spanner nut 92 decreases the number of hardware components typically used in an existing seal assembly with a separate spanner nut and snap element.

Figure 2B:
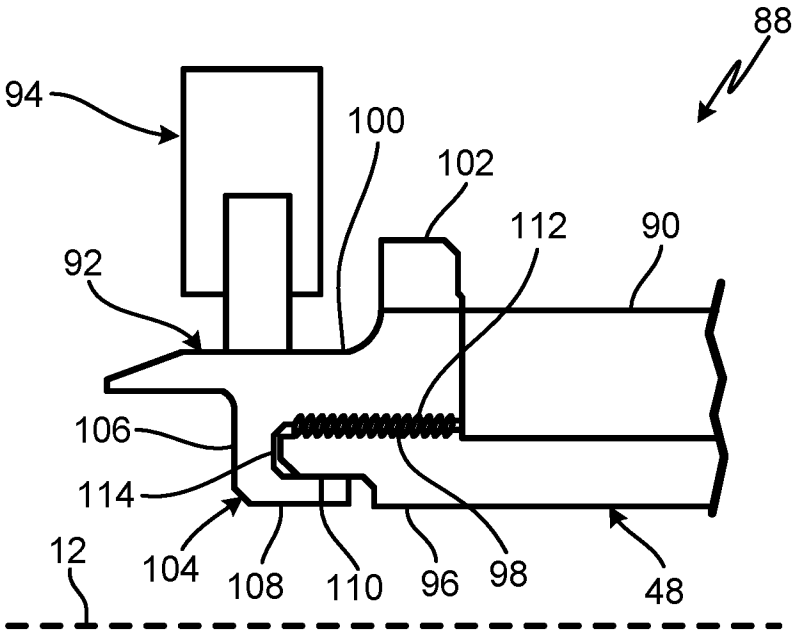
FIG. 2B is an enlarged cross-section view of portion 3-3 in FIG. 2A of a seal assembly with a shaft, bearing stack, spanner nut, and seal element.

FIG. 2B is an enlarged cross-section view of portion 3-3 in FIG. 2A of assembly 88 including high speed shaft 48 (with end 96 and threaded portion 98), bearing stack 90, spanner nut 92 (with body 100, torque receiving tab 102, piloting hook 104 including first extension 106 and second extension 108 with radially outward facing surface 110, threaded portion 112, and channel 114), and seal element 94.

High speed shaft 48 is an elongated tube of solid material. In one non-limiting embodiment, high speed shaft 48 is a hub such as a HPC or LPC hub. End 96 is an end of high speed shaft 48. Threaded portion 98 is a portion of high speed shaft 48 that includes a helical ridge or protrusion. In some non-limiting embodiments, threaded portion 98 can include one of sharp V, American National, Unified Thread Standard (UTS), International Organization for Standardization metric screw, trapezoidal thread form, Whitworth, buttress, breech-lock, or worm threadforms. Body 100 is an annular piece of solid material. Torque receiving tab 102 is a radially extending planar piece of solid material. In this non-limiting embodiment, there is a single torque receiving tab 102. In other non-limiting embodiments, spanner nut 92 can include one or more tabs 102 that are disposed on a radially outward (and/or inward) surface of body 100 of spanner nut 92.

Piloting hook 104 is an annular collar of solid material. First extension 106 is a radially inward extending ring. Second extension 108 is an annular collar. Radially outward facing surface 110 is a surface of second extension 108 that faces radially outward. In one non-limiting embodiment, radially outward facing surface 110 is parallel to axial centerline 12 of engine 10. Threaded portion 112 is a portion of spanner nut 92 that includes a helical ridge or protrusion. Channel 114 is a circumferential gap or opening that forms a receiving space.

End 96 of high speed shaft 48 is located on a distal end of high speed shaft 48 located within bearing compartment 50B. Threaded portion 98 is connected to and extends radially outward from a portion of end 96 of high speed shaft 48. Body 100 is connected to torque receiving tab 102 and to piloting hook 104. Body 100 surrounds a portion of end 96 of high speed shaft 48. Torque receiving tab 102 is connected to and extends radially outward from body 100 of spanner nut 92. Piloting hook 104 is connected to and extends partially radially inward and axially from body 100 of spanner nut 92.

First extension 106 is connected to and extends radially inward from body 100 of spanner nut 92. First extension 106 is connected to and extends radially outward from second extension 108. Second extension 108 is connected to and extends axially from first extension 106. Radially outward facing surface 110 is disposed on second extension 108. Radially outward facing surface 110 is in contact with a radially inward facing surface of high speed shaft 48. Threaded portion 112 is connected to and extends radially inward from body 100 of spanner nut 92. Channel 114 is formed in piloting hook 104 by body 100, first extension 106, and second extension 108.

End 96 of high speed shaft 48 is configured to engage with spanner nut 92 so as to mount spanner nut 92 onto high speed shaft 48. Threaded portion 98 of high speed shaft 48 threadably engages with threaded portion 112 of spanner nut 92 so as to axially retain spanner nut 92 on end 96 of high speed shaft 48. Body 100, torque receiving tab 102, and piloting hook 104 act together as a single monolithic piece. Torque receiving tab 102 functions as a torque receiving element to transfer torque to spanner nut 92 so as to tighten spanner nut 92 onto high speed shaft 48 by way of threaded portions 98 and 112.

Piloting hook 104 is configured to draw second extension 108 radially outward as spanner nut 92 is compressed against bearing stack 90. Drawing second extension 108 radially outward occurs as spanner nut 92 is compressed against bearing stack 90, body 100 of spanner nut 92 expands radially outward thereby drawing first and second extensions 106 and 108 radially outward with body 100. As second extension 108 is drawn radially outward, radially outward facing surface 110 of second extension 108 is brought into contact with the radially inward facing surface of high speed shaft 48. Channel 114 is configured to receive a portion of end 96 of high speed shaft 48.

During a first phase of installation (i.e. Seating Torque procedure), spanner nut 92 is threaded onto high speed shaft 48 (or hub). During this first phase, the transitional snap or gap between high speed shaft 48 and second extension 108 of spanner nut 92 is loose allowing spanner nut 92 to be threaded onto high speed shaft 48 without resistance. As the seating torque is applied to spanner nut 92 (e.g., via torque receiving tab 102), the transitional gap between high speed shaft 48 and second extension 108 of spanner nut 92 remains loose. The first phase of installation involves applying 10-20% of the total amount of torque to spanner nut 92.

During a second phase of installation (i.e., Angle-of-Turn procedure), spanner nut 92 dilates radial outward due to hoop stress building up on spanner nut 92 because of the torque being applied. As spanner nut 92 dilates radially outward, the transitional gap reduces and is eliminated resulting in drawing second extension 108 of spanner nut 92 into a tight condition with the radially inward facing surface of high speed shaft 48. The second phase of installation involves applying 80-90% of the total amount of torque to spanner nut 92. By using the natural dilation of spanner nut 92 resulting from the applied torque and thread profile (see e.g., FIG. 3) of threaded portions 98 and 112, the fit or gap between the radially inward facing surface of high speed shaft 48 and radially outward facing surface 110 of second extension 108 transitions from loose to tight as a prescribed torque is applied to spanner nut 92.

In one non-limiting embodiment, a method of installing spanner nut 92 onto high speed shaft 48 includes threadably engaging spanner nut 92 with end 96 of high speed shaft 48. Bearing stack 90 is disposed on high speed shaft 48. Piloting hook 104 of spanner nut 92 is disposed radially inward from a portion of high speed shaft 48 such that there is a distance greater than zero between radially outward facing surface 110 of piloting hook 104 and a radially inward facing surface of high speed shaft 48.

Spanner nut 92 is rotated relative to high speed shaft 48 such that threaded portion 112 on spanner nut 92 interacts with threaded portion 98 on high speed shaft 48 to translate spanner nut 92 in an axial direction towards bearing stack 90. Spanner nut 92 is brought into contact with bearing stack 90. Spanner nut 92 is tightened against bearing stack 90 such that spanner nut 92 compresses against bearing stack 90. As spanner nut 92 expands radially outward, second extension 108 of piloting hook 104 is drawn radially outward and into contact with the radially inward facing surface of high speed shaft 48.

The benefit of the fit transitioning tight during the angle of turn procedure is that frictional effects are no longer a factor in the amount of axial load applied onto bearing stack 90. This is because, at this step bearing stack 90 is experiencing either compression or extension. Hence, a desired load on bearing stack 90 is achieved while improving the eccentricity of spanner nut 92. Also, transitioning from a loose to a tight fit between piloting hook 104 and end 96 of high speed shaft 48 allows spanner nut 92 to center and have a more co-centric centerline with high speed shaft 48 (or hub) that spanner nut 92 is threaded onto. Having a more concentric centerlines affords several benefits such as to reduce imbalance of the engine system, reduce eccentricity of spanner nut 92, control runout, and decrease a sealing diameter (for lower surface speeds). Other benefits of spanner nut 92 with piloting hook 104 include a compact design, reduced part count, and overall reduction in cost to produce spanner nut 92.

In another non-limiting embodiment, in addition to or in combination with using an amount of torque to dilate spanner nut 92 and encourage a tight fit, the material pairing of spanner nut 92 and high speed shaft 48 to which spanner nut 92 is threaded onto can be such that as the engine or machinery comes to a prescribed temperature, spanner nut 92 and high speed shaft 48 will grow thermally and provide a tight fit between spanner nut 92 and high speed shaft 48.

Figure 3:
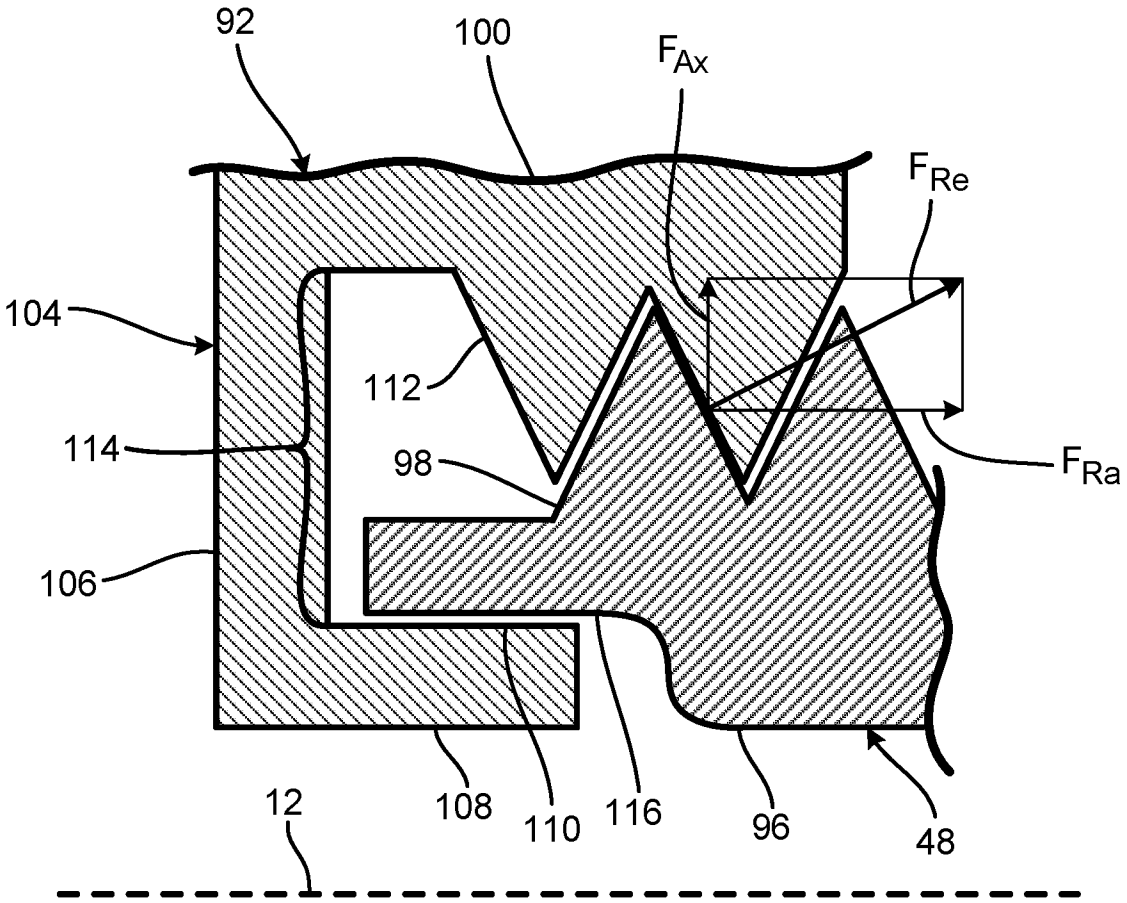
FIG. 3 is an enlarged cross-section view of a portion of a threaded portion of the spanner nut and a threaded portion of the shaft.

FIG. 3 is an enlarged cross-section view of a portion of threaded portion 98 of high speed shaft 48 and threaded portion 112 of spanner nut 92. FIG. 3 shows axial centerline 12, high speed shaft 48 (with end 96, threaded portion 98, and radially inward facing surface 116 of end 96), spanner nut 92 (with body 100, piloting hook 104 including first extension 106 and second extension 108 with radially outward facing surface 110, threaded portion 112, and channel 114), radial force $F_{Ra}$, axial force $F_{Ax}$, and resultant force $F_{Re}$. In the non-limiting embodiment shown in FIG. 3, the relative dimensions, sizes, proportions, and shapes of spanner nut 92 and high speed shaft 48 may or may not be the same as those shown in the non-limiting embodiment of FIGS. 2A and 2B.

Threaded portions 98 and 112 include threads with a triangular cross-section whose radial dimension is greater than an axial dimension. Radial force $F_{Ra}$ includes a force exerted onto threaded portion 112 of spanner nut 92 in a radial direction relative to axial centerline 12. Axial force $F_{Ax}$ includes a force exerted onto threaded portion 112 of spanner nut 92 in an axial direction relative to axial centerline 12. Resultant force $F_{Re}$ includes a force exerted onto threaded portion 112 of spanner nut 92 in a direction resulting from both radial force $F_{Ra}$ and axial force $F_{Ax}$ relative to axial centerline 12. In this non-limiting embodiment, the relative magnitudes or amount of force associated with radial force $F_{Ra}$, axial force $F_{Ax}$, and/or resultant force $F_{Re}$ can be greater or less than those shown in FIG. 3 (which are represented by the length of the arrowheads corresponding to reference characters $F_{Ra}$, $F_{Ax}$, and $F_{Re}$).

As shown in FIG. 3, radially outward facing surface 110 is separated from radially inward facing surface 116 of end 96 of high end shaft 48. This positioning is representative of spanner nut 92 during the first phase of installation (e.g., Seating Torque procedure). In other non-limiting embodiments, a relative size of the gap or space between radially outward facing surface 110 and radially inward facing surface 116 of end 96 can be greater or less than the gap shown in FIG. 3.

During the second phase of installation (e.g., the Angle-of-Turn procedure), threaded portion 98 of end 96 of high speed shaft 48 functions as a wedge such that as an amount of torque applied to spanner nut 92 increases, the radial load (e.g., radial force $F_{Ra}$) increases. As the radial load increases, the axial load (e.g., axial force $F_{Ax}$) also increases and pushes body 100 of spanner nut 92 away from axial centerline 12. As body 100 of spanner nut 92 is pushed radially outward, piloting hook 104 is drawn radially outward causing radially outward facing surface 110 of second extension 108 to come into contact with radially inward facing surface 116 of end 96.

Figure 4:
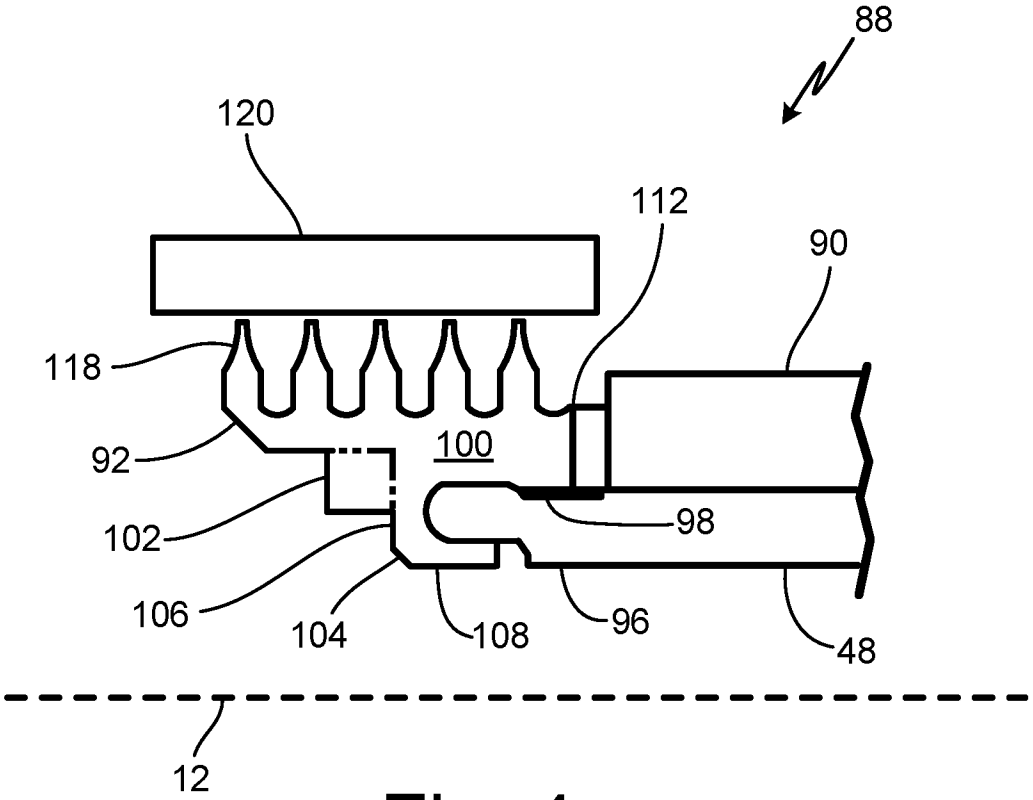
FIG. 4 is a cross-section view of a seal assembly with a shaft, bearing stack, and spanner nut with a knife edge seal.

FIG. 4 shows an embodiment in which spanner nut 92 includes knife edge seal 118. FIG. 4 is a cross-section view of assembly 88 with high speed shaft 48 (including end 96 and threaded portion 98), bearing stack 90, spanner nut 92 (including body 100, torque receiving tab 102, piloting hook 104, first extension 106, second extension 108, threaded portion 112, and knife edge seal 118), and static sealing land 120.

Knife edge seal 118 is a seal including a series of radially extending fingers. Static sealing land 120 is a sealing surface. In this embodiment, torque receiving tab 102 extends radially inwards from a portion of spanner nut 92 due to the relative position of knife edge seal 118 and static sealing land 120. Knife edge seal 118 is connected to and extends radially outwards from body 100 of spanner nut 92. The ends of the fingers of knife edge seal 118 are nearly into contact with static sealing land 120. During operation of engine 10, knife edge seal 118 rotates relative to static sealing land 120 via high speed shaft 48. Static sealing land 120 is mounted to a portion of bearing compartment 50B. Static sealing land 120 surrounds knife edge seal 118. Static sealing land 120 remains static relative to knife edge seal of spanner nut 92 which rotates relative to static sealing land 120.

Knife edge seal 118 is configured to mate and sealingly engage with static sealing land 120 within bearing compartment 50B. Knife edge seal 118 functions to provide a liquid or air sealing capacity. In one non-limiting embodiment, there is a high pressure region on one side of knife edge seal 118 and a low pressure region on an opposite side of knife edge seal 118. The configuration of spanner nut 92 with knife edge seal 118 provides the benefits of a compact design, reduced part count, and overall reduction in cost to produce seal assembly 88.

Figure 5:
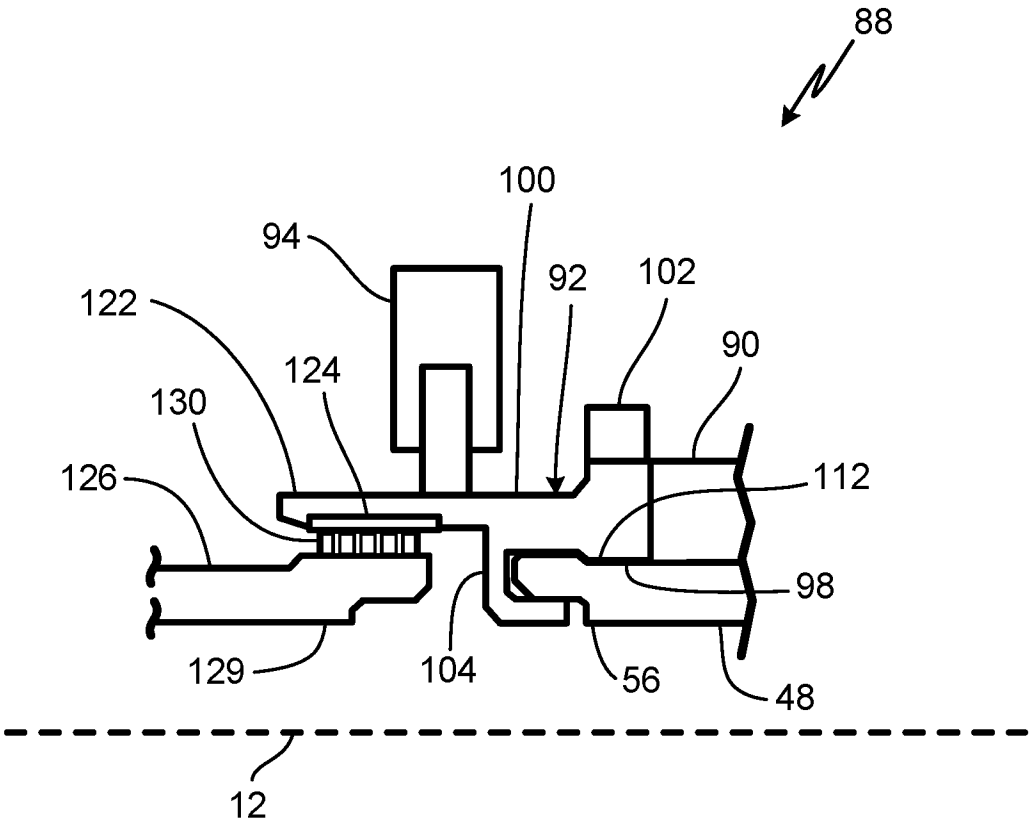
FIG. 5 is a cross-section view of a seal assembly with a first shaft, bearing stack, spanner nut with a seal land, seal element, and second shaft with a knife edge seal.

FIG. 5 shows an embodiment in which spanner nut 92 interacts with second shaft 126 including knife edge seal 130. FIG. 5 is a cross-section view of seal assembly 88 with high speed shaft 48 (including end 96 and threaded portion 98), bearing stack 90, spanner nut 92 (including body 100, torque receiving tab 102, piloting hook 104, threaded portion 112, sealing land 122, and seal insert 124), and second shaft 126 (including end 128 and knife edge seal 130).

Sealing land 122 is a radial extension of solid material. Seal insert 124 is a seal or wear insert. In one non-limiting embodiment, seal insert 124 can include a piece of a carbon, brush, or abradable seal. Second shaft 126 is a rotating shaft or hub of engine 10. In one non-limiting embodiment, second shaft 126 can include low speed shaft 46, high speed shaft 48, HPC hub, or LPC hub. End 128 is an axial, terminal endpoint of second shaft 126. Knife edge seal 130 is a seal including a series of radially extending fingers.

Sealing land 122 is connected to and extends axially from body 100 of spanner nut 92. Seal insert 124 is disposed in a portion of sealing land 122. Seal insert 124 is positioned radially outward from and adjacent to knife edge seal 130 of second shaft 126. Second shaft 126 is axially separated from high speed shaft 48 and is aligned concentrically/co-axial with axial centerline 12. End 128 is positioned on a terminal endpoint of second shaft 126. End 128 of second shaft 126 is disposed radially inward from a portion of sealing land 122. Knife edge seal 130 is connected to and extends radially outward from a portion of end 128 of second shaft 126.

During operation of engine 10, knife edge seal 130 rotates relative to sealing land 122 via the relative rotation between high speed shaft 48 and second shaft 126. Sealing land 122 with seal insert 124 surrounds knife edge seal 130. The ends of the fingers of knife edge seal 130 are nearly into contact with sealing land 122. During operation of engine 10, knife edge seal 130 rotates relative to sealing land 122 via second shaft 126.

Knife edge seal 130 is configured to mate and sealingly engage with sealing land 122 within bearing compartment 50B. Knife edge seal 130 functions to provide a liquid or air sealing capacity. In one non-limiting embodiment, there is a high pressure region on one side of knife edge seal 130 and a low pressure region on an opposite side of knife edge seal 130. The configuration of spanner nut 92 in combination with second shaft 126 with knife edge seal 130 provides the benefits of a compact design, reduced part count, and overall reduction in cost to produce spanner nut 92. Knife edge seal 130 also seals an intershaft cavity between high speed shaft 48 and second shaft 126.

Figure 6:
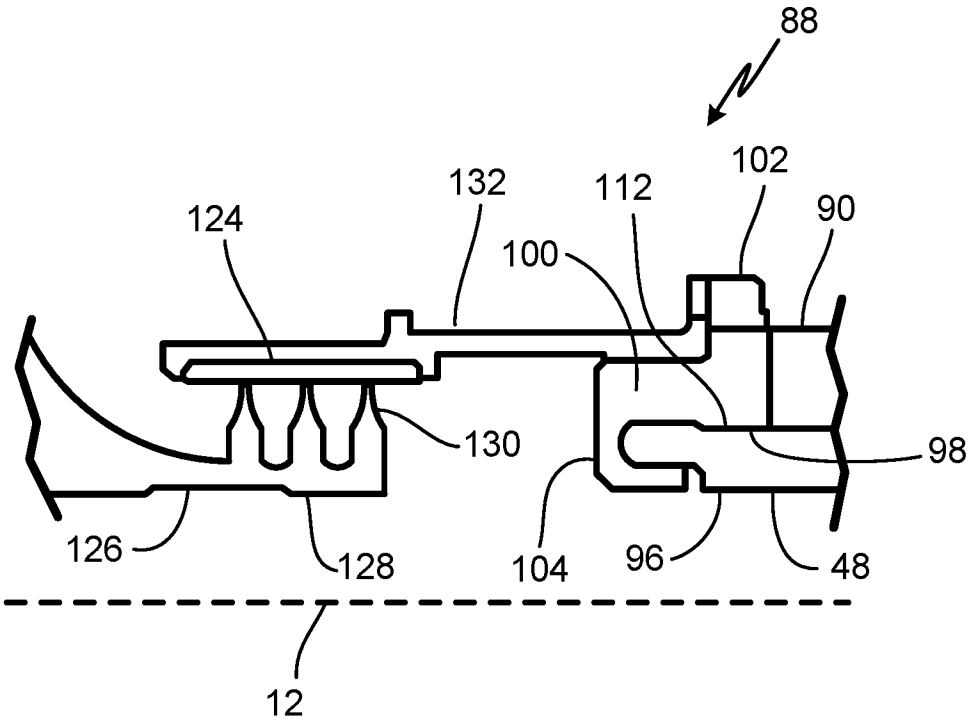
FIG. 6 is a cross-section view of a seal assembly with a shaft, bearing stack, spanner nut, intershaft seal element, and second shaft with a knife edge seal.

FIG. 6 shows an embodiment in which spanner nut 92 with inter-shaft sealing component 132 interacts with second shaft 126 including knife edge seal 130. FIG. 6 is a cross-section view of seal assembly 88 with high speed shaft 48 (including end 96 and threaded portion 98), bearing stack 90, spanner nut 92 (including body 100, torque receiving tab 102, piloting hook 104, threaded portion 112, inter-shaft sealing component 132, and seal insert 124), and second shaft 126 (including end 128 and knife edge seal 130).

Seal insert 124 is a seal or wear insert. In this non-limiting embodiment, seal insert 124 includes an abradable. Inter-shaft sealing component 132 is a radial extension of solid material. Seal insert 124 is mounted to a radially inner portion of inter-shaft sealing component 132. Seal insert 124 is also in contact with knife edge seal 130 of second shaft 126. During operation of engine 10, knife edge seal 130 rotates relative to and rubs against seal insert 124 of inter-shaft sealing component 132. The benefits of seal assembly 88 with spanner nut 92 including inter-shaft sealing component 130 include less run out of the sealing interface between seal insert 124 and knife edge seal 130 which translates into less wear, less degradation of the seal, and less blow-by of fluid across the sealing interface.

Figure 7:
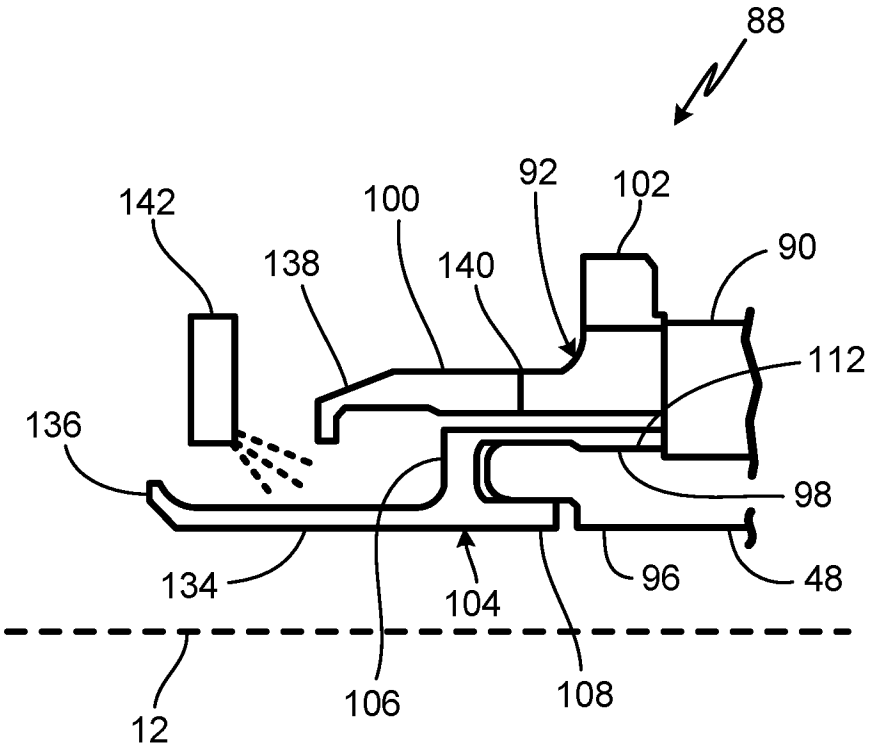
FIG. 7 is a cross-section view of a seal assembly with a shaft, bearing stack, oil nozzle, and spanner nut with a scoop and passage.

FIG. 7 shows an embodiment in which spanner nut 92 with scoop 138 is positioned to collect lubricant from nozzle 142. FIG. 7 is a cross-section view of assembly 88 with high speed shaft 48 (including end 96 and threaded portion 98), bearing stack 90, spanner nut 92 (including body 100, torque receiving tab 102, piloting hook 104, first extension 106, second extension 108, threaded portion 112, ring 134, lip 136, scoop 138, and passage 140), and nozzle 142. Ring 134 is an annular band of solid material. Lip 136 is a curved edge. Scoop 138 is an annular ring with a curved lip extending radially inwards. Passage 140 is a channel configured to transport a fluid. Nozzle 142 is a spout configured to control emission of a liquid such as a coolant or lubricant.

Ring 134 is connected to and extends axially from first extension 106 of piloting hook 104. Lip 136 is connected to and extends both radially and axially from an end of ring 134 that is opposite from second extension 108. Scoop 138 is connected to and extends both radially and axially from a portion of body 100. Scoop 138 forms a catchment region in which fluid can be contained. Passage 140 is disposed in and through a portion of body 100. Passage 140 fluidly connects scoop 138 to bearing stack 90. In this non-limiting embodiment, a single passage 140 is shown in spanner nut 92. In other non-limiting embodiments, more than one passage 140 can be disposed in spanner nut 92 and at different angles relative to axial centerline than shown in FIG. 7. Nozzle 142 is disposed in a portion of bearing compartment 50B. A discharge opening disposed in nozzle 142 is aimed in the general direction of ring 134 of spanner nut 92.

Ring 134 functions to catch coolant or lubricant emitted from nozzle 142. Lip 136 functions to catch any coolant or lubricant that travels axially forward of nozzle 142, and prevent the coolant or lubricant from passing axially beyond lip 136. Scoop 138 functions to catch any coolant or lubricant that is flung off of ring 134 and prevents the coolant or lubricant from spraying into other portions of bearing compartment 50B. Passage 140 functions to transport the coolant or lubricant caught by scoop 138 to bearing stack 90 for the purposes of either heat transfer or lubrication of bearing stack 90. Nozzle 142 functions to provide coolant or lubricant within bearing compartment 50B.

Assembly 88 with scoop 138, passage 140, and nozzle 142 provides the benefit of a single piece of hardware to both control runout of spanner nut 92 and deliver coolant and/or lubricant to bearing stack 90.

Figure 8:
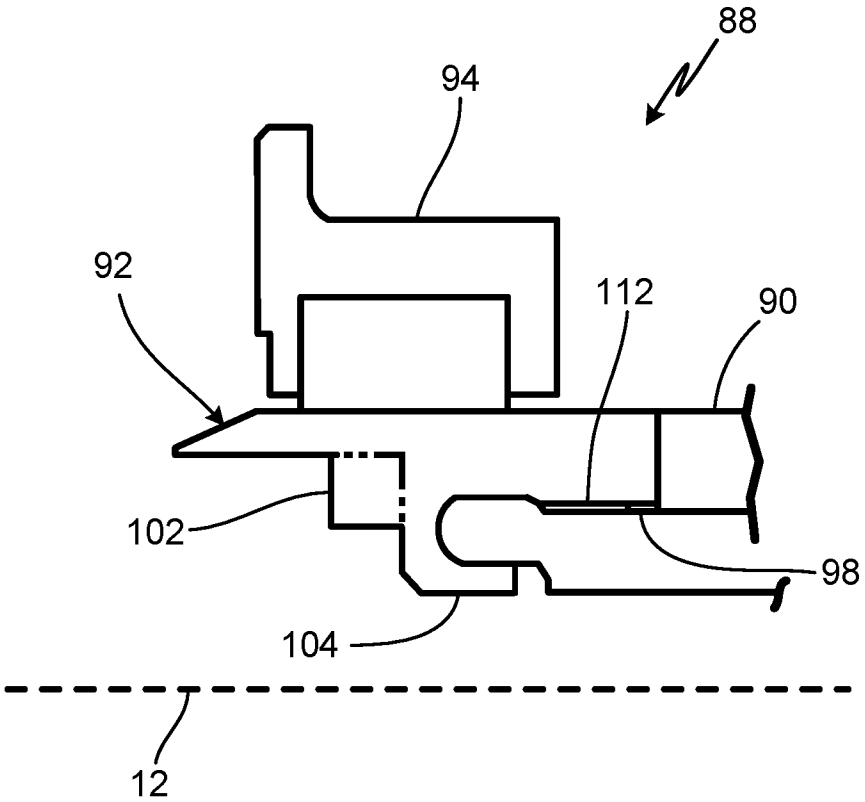
FIG. 8 is a cross-section view of a seal assembly with a shaft, bearing stack, seal element, and spanner nut with a torque tab.

FIG. 8 shows an embodiment in which spanner nut 92 includes a radially inward torque receiving tab 102 and engages with seal element 94. FIG. 8 is a cross-section view of seal assembly 88 with high speed shaft 48 (including end 96 and threaded portion 98), bearing stack 90, spanner nut 92 (including body 100, torque receiving tab 102, piloting hook 104, and threaded portion 112), and seal element 94. In this non-limiting embodiment, torque receiving tab 102 extends radially inward from a portion of body 100 of spanner nut 92 (as compared to extending radially outward from body 100 of spanner nut 92 as shown in FIG. 5). This configuration of spanner nut 92 allows for access to torque receiving tab 102 at a radius less than a radius of seal element 94, which is useful in instances where seal element 94 prevents access to radially outward extending tabs.

Figure 9:
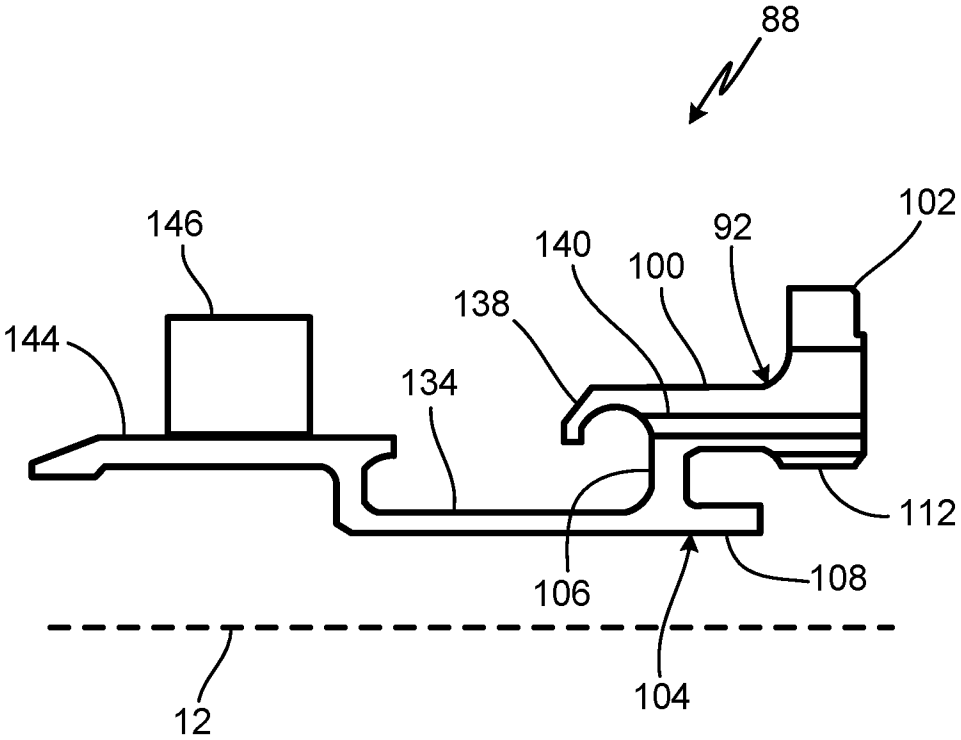
FIG. 9 is a cross-section view of a seal assembly with a shaft, bearing stack, seal element, and spanner nut with a passage, scoop, and seal runner.

FIG. 9 shows an embodiment in which spanner nut 92 includes a scoop 138 and seal runner 144. FIG. 9 is a cross-section view of assembly 88 with bearing stack 90, spanner nut 92 (including body 100, torque receiving tab 102, piloting hook 104, first extension 106, second extension 108, threaded portion 112, ring 134, scoop 138, and passage 140), seal runner 144, and seal element 146. The embodiment shown in FIG. 9 includes a configuration of scoop 138 and passage 140 in combination with seal runner 144 and seal element 146. This non-limiting embodiment combines multiple elements from previously discussed embodiments and provides the benefit of reduction in part count and an integrated functioning component which reduces runout of the entire assembly.

DISCUSSION OF POSSIBLE EMBODIMENTS

The following are non-exclusive descriptions of possible embodiments of the present invention.

A spanner nut for a bearing compartment of an engine with a bearing stack on a first shaft that rotates about an engine centerline includes a body, a piloting hook connected to the body, a first threaded portion, and a channel formed by the piloting hook. The piloting hook includes first and second extensions. The first extension is connected to and extends radially inward from the body. The second extension is connected to and extends in an axial direction from the first extension. The second extension includes a radially outward facing surface. The first threaded portion is configured to engage with a second threaded portion on the end of the first shaft. The channel is configured to receive the end of the first shaft. The piloting hook is configured to draw the second extension radially outward as the spanner nut is compressed.

The spanner nut of the preceding paragraph can optionally include, additionally and/or alternatively, any one or more of the following features, configurations and/or additional components.

The radially outward facing surface of the second extension can be parallel to the centerline of the engine.

The radially outward facing surface of the second extension can be in contact with a radially inward facing surface of the first shaft.

A seal element that can be sealingly engaged with the spanner nut.

A knife edge seal can be connected to and/or extend radially outward from the body of the spanner nut, wherein the knife edge seal can be configured to form a seal with a static sealing land of the engine.

A second shaft can be disposed in the engine and/or co-axial with the engine centerline, a seal element can be disposed on a portion of the second shaft, and/or a sealing land can be connected to and/or extend axially from the body of the spanner nut, wherein the sealing land can engage with the seal element of the second shaft such that the sealing land and/or the seal element form a seal.

A nozzle can be disposed within the bearing compartment, a scoop can be connected to and/or extend axially from the body of the spanner nut, wherein the scoop can be configured to collect lubricant emitted from the nozzle, and/or a passage can extend through a portion of the body of the spanner nut, wherein the passage can be configured to transport lubricant from the scoop to the bearing stack.

A tab can extend radially from a portion of the body, wherein the tab can be configured to receive and/or transfer torque to the spanner nut.

A method of installing a spanner nut onto a shaft in a bearing compartment of an engine includes threadably engaging the spanner nut with an end of the shaft. A bearing stack is disposed on the shaft. A piloting hook of the spanner nut is disposed radially inward from a portion of the shaft such that there is a distance greater than zero between a radially outward facing surface of the piloting hook and a radially inward facing surface of the shaft. The spanner nut is rotated relative to the shaft such that threading on the spanner nut interacts with threading on the shaft to translate the spanner nut in an axial direction towards the bearing stack. The spanner nut is brought into contact with the bearing stack. The spanner nut is tightened against the bearing stack such that the spanner nut compresses against the bearing stack and the spanner nut expands radially outward drawing the piloting hook radially outward and into contact with the inner surface of the shaft.

The method of the preceding paragraph can optionally include, additionally and/or alternatively, any one or more of the following steps, features, configurations and/or additional components.

A scoop of the spanner nut can be positioned in a location enabling the scoop to collect lubricant emitted from a nozzle disposed in the bearing compartment.

Torque can be received with torque tabs that extend radially from a portion of the spanner nut.

A second shaft can be aligned co-axially with the first shaft, and/or a sealed interface can be formed between the second shaft and a portion of the spanner nut.

An assembly for a bearing compartment of an engine includes a first shaft disposed in the engine and co-axial with the engine centerline, a bearing stack disposed on a portion of the first shaft, and a spanner nut disposed on the end of the first shaft and in contact with the bearing stack. The first shaft includes an end with a radially inward facing surface and a first threaded portion disposed on the end of the shaft. The spanner nut includes a body, a piloting hook connected to the body, a second threaded portion configured to engage with the first threaded portion on the end of the first shaft, and a channel formed by the piloting hook. The piloting hook includes first and second extensions. The first extension is connected to and extends radially inward from the body. The second extension is connected to and extends in an axial direction from the first extension. The second extension includes a radially outward facing surface. The channel is configured to receive the end of the first shaft. The piloting hook is configured to cause the radially outward facing surface of the second extension to contact the radially inward facing surface of the end of the shaft.

The assembly of the preceding paragraph can optionally include, additionally and/or alternatively, any one or more of the following features, configurations and/or additional components.

The radially outward facing surface of the second extension can be parallel to the centerline of the engine.

A seal element can be in sealingly engaged with the spanner nut.

A knife edge seal can be connected to and/or extend radially outward from the body of the spanner nut, wherein the knife edge seal can be configured to form a seal with a static sealing land of the engine.

A second shaft can be disposed in the engine and co-axial with the engine centerline, a seal element can be disposed on a portion of the second shaft, and/or a sealing land can be connected to and/or extend axially from the body of the spanner nut, wherein the sealing land can engage with the seal element of the second shaft such that the sealing land and the seal element can form a seal.

A nozzle can be disposed within the bearing compartment, a scoop can be connected to and/or extend axially from the body of the spanner nut, wherein the scoop can be configured to collect lubricant emitted from the nozzle, and/or a passage can extend through a portion of the body of the spanner nut, wherein the passage can be configured to transport lubricant from the scoop to the bearing stack.

A tab can extend radially from a portion of the body, wherein the tab can be configured to receive and/or transfer torque to the spanner nut.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A gas turbine engine assembly for a bearing compartment of an engine, the gas turbine engine assembly comprising:

a first shaft disposed in the engine and co-axial with the engine centerline, wherein the first shaft comprises:

an end with a radially inward facing surface; and a first threaded portion disposed on the end of the shaft;

a bearing stack disposed on a portion of the first shaft; and a spanner nut disposed on the end of the first shaft and in contact with the bearing stack, wherein the spanner nut comprises:

a body;

a piloting hook connected to the body, the piloting hook comprising:

a first extension connected to and extending radially inward from the body; and a second extension connected to and extending in an axial direction from the first extension, wherein the second extension includes a radially outward facing surface;

a first threaded portion configured to engage with a second threaded portion on an end of the first shaft; and a channel formed by the piloting hook, wherein the channel is configured to receive the end of the first shaft, wherein the piloting hook is configured to draw the second extension radially outward as the spanner nut is compressed.

2. The gas turbine engine assembly of claim 1, wherein the radially outward facing surface of the second extension is parallel to the centerline of the engine.

3. The gas turbine engine assembly of claim 1, wherein the radially outward facing surface of the second extension is in contact with a radially inward facing surface of the first shaft.

4. The gas turbine engine assembly of claim 1, further comprising a seal element that is sealingly engaged with the spanner nut.

5. The gas turbine engine assembly of claim 1, further comprising a knife edge seal connected to and extending radially outward from the body of the spanner nut, wherein the knife edge seal is configured to form a seal with a static sealing land of the engine.

6. The gas turbine engine assembly of claim 1, further comprising:

a second shaft disposed in the engine and co-axial with the engine centerline;

a seal element disposed on a portion of the second shaft; and a sealing land connected to and extending axially from the body of the spanner nut, wherein the sealing land engages with the seal element of the second shaft such that the sealing land and the seal element form a seal.

7. The gas turbine engine assembly of claim 1, further comprising:

a nozzle disposed within the bearing compartment;

a scoop connected to and extending axially from the body of the spanner nut, wherein the scoop is configured to collect lubricant emitted from the nozzle; and a passage extending through a portion of the body of the spanner nut, wherein the passage is configured to transport lubricant from the scoop to the bearing stack.

8. The gas turbine engine assembly of claim 1, wherein the spanner nut comprises a tab extending radially from a portion of the body, wherein the tab is configured to receive and transfer torque to the spanner nut.

9. A method of installing a spanner nut onto a shaft in a bearing compartment of an engine, the method comprising:

threadably engaging the spanner nut with an end of the shaft, wherein a bearing stack is disposed on the shaft, wherein a piloting hook of the spanner nut is disposed radially inward from a portion of the shaft such that there is a distance greater than zero between a radially outward facing surface of the piloting hook and a radially inward facing surface of the shaft;

rotating the spanner nut relative to the shaft such that threading on the spanner nut interacts with threading on the shaft to translate the spanner nut in an axial direction towards the bearing stack;

bringing the spanner nut into contact with the bearing stack; and tightening the spanner nut against the bearing stack such that the spanner nut compresses against the bearing stack and the spanner nut expands radially outward drawing the piloting hook radially outward and into contact with the radially inward facing surface of the shaft.

10. The method of claim 9, further comprising positioning a scoop of the spanner nut in a location enabling the scoop to collect lubricant emitted from a nozzle disposed in the bearing compartment.

11. The method of claim 9, wherein threadably engaging the spanner nut with the end of the shaft further comprises receiving torque with torque tabs that extend radially from a portion of the spanner nut.

12. The method of claim 9, further comprising:

aligning a second shaft co-axially with the first shaft; and forming a sealed interface between the second shaft and a portion of the spanner nut.

13. An assembly for a bearing compartment of an engine, the assembly comprising:

a first shaft disposed in the engine and co-axial with the engine centerline, wherein the first shaft comprises:

an end with a radially inward facing surface; and a first threaded portion disposed on the end of the shaft;

a bearing stack disposed on a portion of the first shaft; and a spanner nut disposed on the end of the first shaft and in contact with the bearing stack, wherein the spanner nut comprises:

a body;

a piloting hook connected to the body, the piloting hook comprising:

a first extension connected to and extending radially inward from the body; and a second extension connected to and extending in an axial direction from the first extension, wherein the second extension includes a radially outward facing surface;

a second threaded portion configured to engage with the first threaded portion on the end of the first shaft; and a channel formed by the piloting hook, wherein the channel is configured to receive the end of the first shaft, wherein the piloting hook is configured to cause the radially outward facing surface of the second extension to contact the radially inward facing surface of the end of the shaft.

14. The assembly of claim 13, wherein the radially outward facing surface of the second extension is parallel to the centerline of the engine.

15. The assembly of claim 13, further comprising a seal element that is sealingly engaged with the spanner nut.

16. The assembly of claim 13, further comprising a knife edge seal connected to and extending radially outward from the body of the spanner nut, wherein the knife edge seal is configured to form a seal with a static sealing land of the engine.

17. The assembly of claim 13, further comprising:

a second shaft disposed in the engine and co-axial with the engine centerline;

a seal element disposed on a portion of the second shaft; and a sealing land connected to and extending axially from the body of the spanner nut, wherein the sealing land engages with the seal element of the second shaft such that the sealing land and the seal element form a seal.

18. The assembly of claim 13, further comprising:

a nozzle disposed within the bearing compartment;

a scoop connected to and extending axially from the body of the spanner nut, wherein the scoop is configured to collect lubricant emitted from the nozzle; and a passage extending through a portion of the body of the spanner nut, wherein the passage is configured to transport lubricant from the scoop to the bearing stack.

19. The assembly of claim 13, wherein the spanner nut comprises a tab extending radially from a portion of the body, wherein the tab is configured to receive and transfer torque to the spanner nut.

* * * * *